United States Patent [19]

Magder

[11] Patent Number: 4,711,495

[45] Date of Patent: Dec. 8, 1987

[54] UPHOLSTERED FURNITURE

[75] Inventor: Max Magder, Milton, Canada

[73] Assignee: DuBarry Furniture of Canada Limited, Toronto, Canada

[21] Appl. No.: 920,909

[22] Filed: Oct. 17, 1986

Related U.S. Application Data

[63] Continuation of Ser. No. 685,928, Dec. 24, 1984.

[30] Foreign Application Priority Data

Dec. 14, 1984 [CA] Canada ..... 470175

[51] Int. Cl.[4] ..... A47C 7/00

[52] U.S. Cl. ..... 297/440; 297/455; 297/218

[58] Field of Search ..... 297/440, 455, 422, 218; 5/410, 409, 402

[56] References Cited

U.S. PATENT DOCUMENTS

| | | | |
|---|---|---|---|
| 2,567,550 | 9/1951 | Clark et al. | 5/402 |
| 2,732,889 | 1/1956 | Healey | 297/440 X |
| 3,022,522 | 2/1962 | Neely | 5/409 |
| 3,081,131 | 3/1963 | Brueder | 297/455 |
| 3,104,913 | 9/1963 | Faulkner et al. | 297/440 |
| 3,462,196 | 8/1969 | Arnold et al. | 297/455 |
| 3,649,974 | 3/1972 | Baruth et al. | 5/402 |
| 4,232,899 | 11/1980 | Fister | 297/455 |
| 4,305,616 | 12/1981 | Martinez | 297/440 |

FOREIGN PATENT DOCUMENTS

| | | | |
|---|---|---|---|
| 1047176 | 1/1979 | Canada | 5/409 |
| 8201623 | 11/1983 | Netherlands | 297/226 |

*Primary Examiner*—Francis K. Zugel

*Attorney, Agent, or Firm*—Rogers, Bereskin & Parr

[57] ABSTRACT

The invention relates to the field of furniture typically described as upholstered furniture and relates to both individual chairs and multiple seats such as sofas, chesterfields, love seats and the like. The furniture comprises a tubular base having wire springs across the upper surface to comprise a seating surface. Supporting material may be glued to the tubular base. Fabric of an upholstered appearance is placed on the base and extends downwardly around the base and then upwardly ending adjacent the spring wires. The fabric is fixed in place by use of staple fasteners such as wire rings adjoining the fabric to the wire springs. Back and side elements are detachably affixed to the base by screws so that the furniture may be knocked down for shipment.

3 Claims, 6 Drawing Figures

UPHOLSTERED FURNITURE

This application is a continuation of application Ser. No. 685,928, filed Dec. 24, 1984.

This invention relates to the field of furniture normally described as upholstered furniture. Such furniture is basically used for supporting individuals in a sitting position and may be of sufficient extent to support one person as in a chair or a plurality of persons in which case the furniture is identified by such names as a love seat, a chesterfield or a sofa. In this patent the term "seating furniture" is used to collectively describe all such furniture.

The traditional structure of seating furniture involves the construction of a wooden frame to which suitable springs are added and then the frame is upholstered with suitable padding and fabric. The task of upholstering such furniture either in the initial manufacture of the furniture or rebuilding the furniture after excessive wear is a time consuming and expensive procedure involving the use of skilled craftsmen. Typically, upholstery is attached to the frame of such furniture by means of tacks, nails or the like and the installation of such upholstery on such frames is a time consuming and costly procedure.

Seating furniture, particularly, larger versions capable of seating two or more persons are relatively bulky items which are expensive to ship long distances. By the nature of typical seating furniture the furniture cananot be made in a modular or knock-down fashion as the arms, back and base are normally permanently fastened together in the furniture manufacturing facility. With such typical furniture the completed chair or sofa must be shipped to the selling facility requiring an extensive amount of shipping room in view of the nature of the product and the steps that must be taken to protect the upholstery during the course of shipping.

Accordingly, it is an object of this invention to provide a form of seating furniture having the comfort and appearance of typical seating furniture which does not require the traditional skills and time of upholstery. Another object of this invention is to provide seating furniture which is readily taken apart or knocked down for shipment between the manufacturing facility and the selling facility or between the selling facility and the users premises.

According to the invention, seating furniture is provided comprising a base for supporting at least one seat cushion and an element for supporting at least one back cushion. There is also provided at least one end element. Fastening means are provided for removably securing the back element and the end element to the base. The base comprises a plurality of tubular members affixed to one another and defining the perimeter of a substantially rectangular prism. A plurality of spring wires extend between two of the tubular members of the base and comprise a seat cushion supporting plane. A sheet of resilient cushioning material is affixed to at least one of the tubular members and overlies the plane of spring wires. An upholstery fabric overlies at least the plane and the cushioning material and has a panel which depends from the plane. The panel extends from the plane around at least one of the tubular members of the base and extends to an edge which is adjacent the plane. A plurality of staple fasteners fasten the panel of the fabric to the base.

The invention may be more clearly understood from the description of a preferred embodiment of the invention which is illustrated in the attached figures, and in which.

In the preferred embodiment illustrated in the figures the seating furniture comprises a base portion 10 for supporting one or more seating cushions which are illustrated in phantom lines only for purposes of clarity of illustration of the structure of the base 10. In addition, the furniture comprises an element 12 for supporting one or more back cushions which are not illustrated for purposes of clarity in illustrating the structure of the element. The furniture further comprises at least one end element 14 which may constitute an arm for the furniture.

Figure 2:
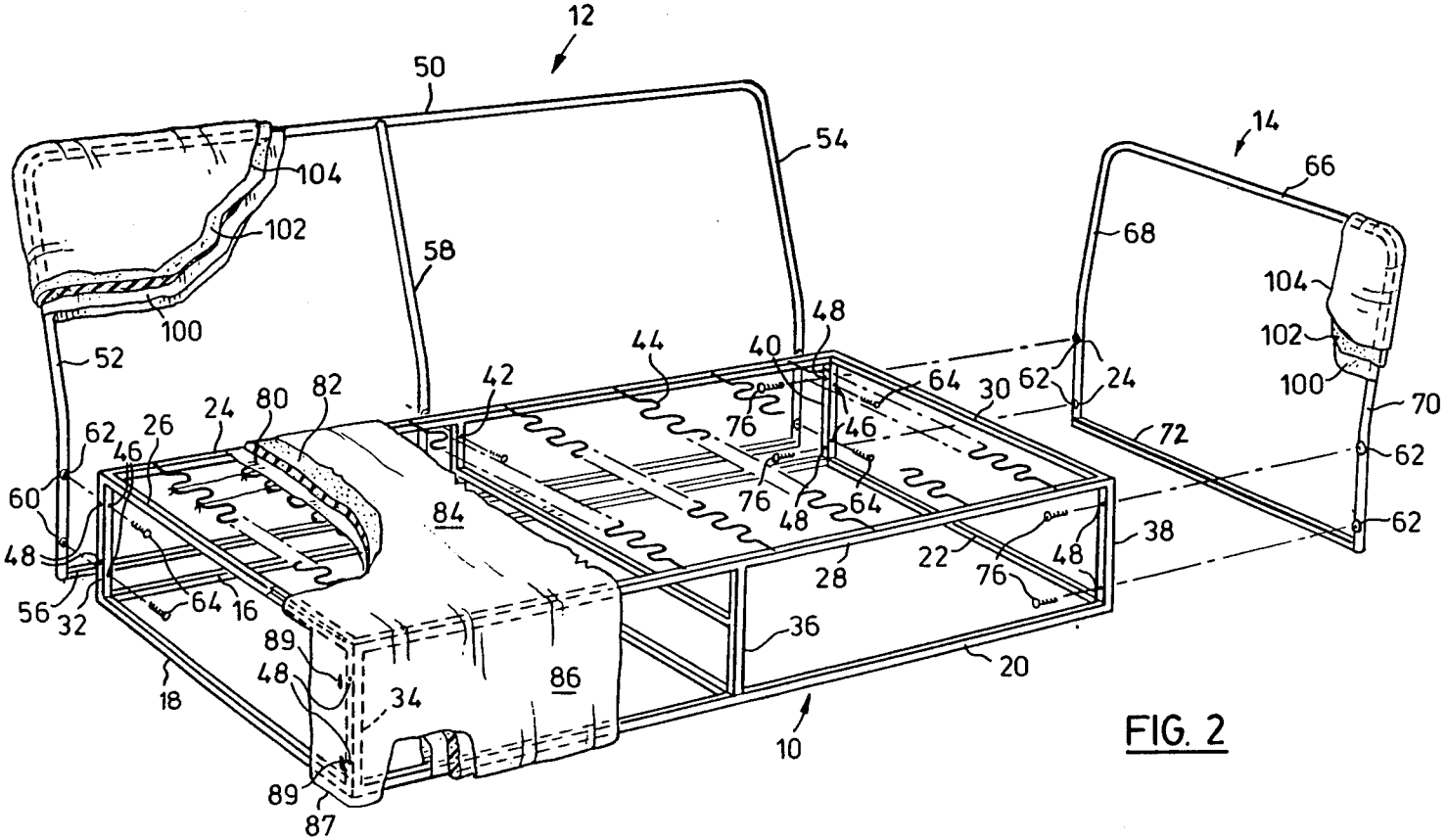
FIG. 2 is an exploded view of the structural elements of the sofa of FIG. 1.

The construction of the various components of the furniture is illustrated in FIG. 2. Each of the components comprises a plurality of members defining a framework. The base portion 10 comprises a plurality of members affixed to one another and defining the perimeter of the base portion which has the shape of a substantially rectangular prism. The base portion comprises four lower members 16, 18, 20 and 22, all lying in substantially the same plane. In addition, there are four similar upper members 24, 26, 28 and 30, and all lying substantially in a second plane. The upper members are supported above the lower members by six upstanding members 32, 34, 36, 38, 40 and 42. All of the members comprising the base are advantageously manufactured from square, tubular, metallic members readily available. The material is chosen such that these members may be readily affixed to one another such as by welding. Of course, it will be obvious to those skilled in the art, that any one or more of the various members may be made from a single piece of tubing suitably bent to constitute the members described herein.

The upper plane of the base 10 defined by members 24, 26, 28 and 30 comprises the plane upon which the seat cushions will rest. Standard furniture springs 44 extending between the members 24 and 28 serve to further comprise this plane. It will be obvious to those skilled in this field that the number and placement of such springs is a matter of choice depending upon the strength of the springs and the load to be supported by the furniture. Advantageously the springs are retained in place by down-turned elements of the spring wire which are received in apertures drilled in upper surface of members 24 and 28 respectively.

Members 32 and 40 most readily apparent in FIG. 2, include a series of holes extending completely through the tubing for receiving bolts. Member 32 comprises two holes 46 in the front face and two holes 48 in the side face. It will be observed that holes 46 and 48 are each respectively offset vertically one from the other in order to permit a bolt to be passed horizontally through the member, one through each of the holes 46 and one through each of holes 48. Similar holes are provided in member 40. Member 42 may also have holes 46 if desired. The front upstanding members 34 and 38 each comprise a pair of holes 48 extending completely through the tubular members, in each case in the side face.

Holes 46 are provided in members 32 and 40 in order that screws may be passed through the holes to retain the element for supporting the back cushions against the base. Holes 48 are provided for securing end elements 14 to either end of the base. The manner of attaching the back element and one or more end elements will be more readily apparent after describing these individual structures.

The element 12 for supporting the back cushions 12 is clearly shown in FIG. 2. The element 12 is most readily constructed from a tube bent into a downwardly opening U-shape having a substantially horizontal run 50 and two downwardly extending runs 52 and 54. The lower perimeter of the element comprises a tube 56 welded at either end to the extremity of runs 52 and 54. For additional support, member 58 is welded to run 50 and tube 56. Additional such members may be included as length requires.

The two runs 52 and 54, and, if desired, member 58, are each provided in their front facing surface with a pair of apertures 60. These apertures advantageously extend substantially horizontally directly through members 52 and 54. Nuts 62 for receiving threaded fasteners are retained at each of the front facing portions of the apertures 60. Such snap-in nuts for being retained in such apertures are readily available under the trade name SNAP-NUT. Other types of nuts such as wing nuts may be utilized if desired.

The element 12 may be fixed to the base portion 10 by simply passing bolts 64 horizontally through each of the apertures 46 and threading the bolts 64 into the nuts 62 received within apertures 60. This is shown in chain dotted lines in FIG. 2. Thus, the back element is readily removably fixed to the base portion 10. The element 12 should preferably be affixed by at least four bolts, more being utilized if length so requires.

The end elements 14 may be constructed in a manner similar to the back element 12. The end element 14 advantageously comprises a downwardly opening U-shaped tube having a substantially horizontal run 66 and two downwardly extending runs 68 and 70. The lower perimeter of the panel comprises a tube 72 welded at either end to the extremities of runs 68 and 70. The two runs 68 and 70 are each provided in their inwardly facing surface with a pair of apertures 74 which extend substantially horizontally through the runs. Each aperture contains a similar nut 62.

The end element 14 may be fixed to the base portion 10 by passing four bolts 76 horizontally through each of the four apertures 48 and threading the bolts 76 into the nut 62 retained in apertures 74. This is shown in chain dotted lines in FIG. 2. Thus, the end element is readily removably fixed to the base portion 10.

The method of covering the structural portions of the furniture will now be explained. After metal assembly of base 10 is finished and the spring wires 44 are in place, the upper surface of the prism is first covered with a supporting web 80 which may be affixed to the upper surface comprising elements 24, 26, 28 and 30 so as to extend completely over the plane constituted by these four elements and the spring wires. The purpose of the supporting web is to cover the springs and to provide support for the subsequent layers of material. It is suggested that in most cases the supporting web be affixed to the base by gluing the web to the elements 24, 26, 28 and 30. Examples of particularly suitable materials for the supporting web include the sheet products identified by the Dupont Company as FABRINE and TYPAR.

After the sheet of supporting web 80 is in place, a synthetic foam cushioning material 82 is used to cover the upper surface and the frontal portion of the base 10. The cushioning material may be polyurethane foam or the like. This material is retained in place by gluing to the supporting web 80 or to the various members of the base. The material is shown in partial section in FIG. 2.

In order to provide the base with an upholstered appearance without actually undertaking the usual steps of upholstery a sheet of fabric comprising an upper panel 84 and a depending panel 86 is prepared. The fabric shown in FIGS. 3, 4 and 6 comprises a fabric having the appropriate appearance of the finished furniture. At least the panel 86 of the fabric 84 which will rest against members 34, 36 and 38 will comprise a pleasing upholstered appearance. It is suggested that the remainder of the fabric also be manufactured of the same material, although this is optional.

Figure 3:
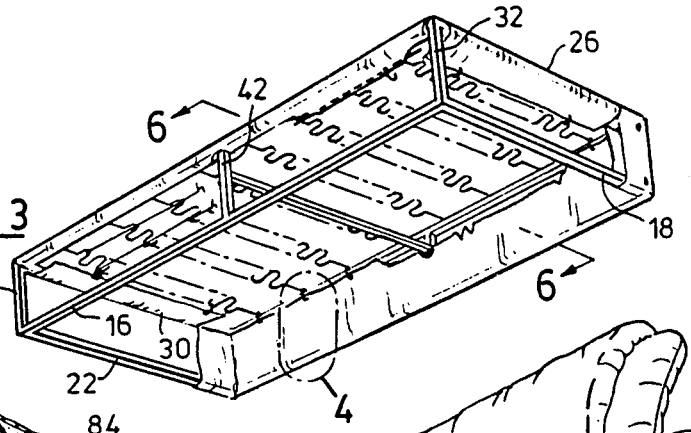
FIG. 3 is a view of the underside from the rear of the base member showing the attachment of the fabric.
Figure 4:
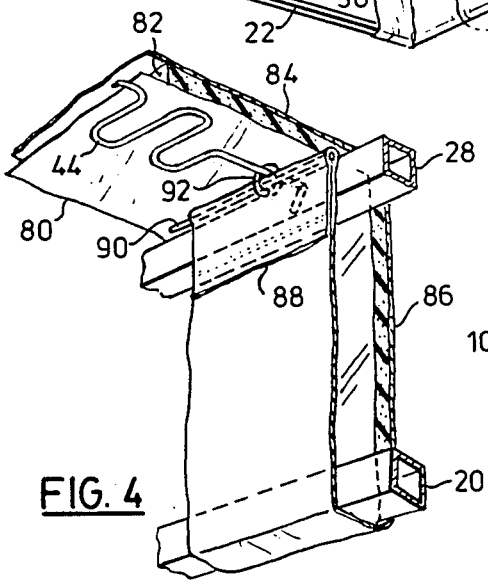
FIG. 4 is an enlarged view of the circled area identified by the numeral 4 of FIG. 3.
Figure 6:
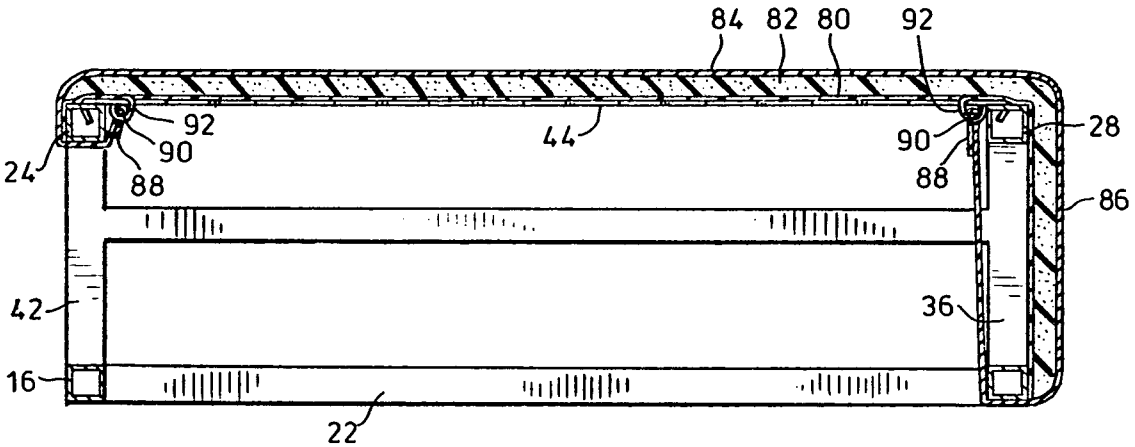
FIG. 6 is a cross-sectional view along line 6—6 of FIG. 3.

From review of FIGS. 3, 4 and 6, it will be apparent as to how the fabric is attached to the base element 10. The fabric extends forwardly from the vicinity of the member 24 across the plane comprised by the spring wires. The fabric having the desired appearance extends over element 28 and down the front of the sofa. The fabric then traverses around element 20 and extends up the rear of the front panel of the base terminating in an edge which is located closely adjacent to the plane comprised of the spring wires.

The edge of the depending panel comprises a flap which extends back and which is sewn to the panel to comprise two longitudinal pockets 88 extending along the edge of the fabric on either side of member 36. A reinforcing rod 90 is contained within the pocket 88. The reinforcing rod may comprise a straight spring wire or the like. The reinforcing rod 90 is closely adjacent to a plurality of the spring wires 44.

As shown in FIGS. 4 and 6 the fabric is attached to the base by use of staple fasteners 92. The term, :staple fasteners" as used in this disclosure and claims is intended to cover looped wire fasteners of the type which are formed into a closed loop by a machine such as a stapler or the like and which retain their folded over configuration after installation. Such staples are often referred to in the furniture industry as "hog rings". Equipment is readily available for the installation of hog rings.

The reinforcing rod 90 and pocket 88 at the edge of the depending panel comprise the attachment point for the fabric to the base 10. A similar configuration is used to attach the upper rearward portion of the fabric 84 to the base. By reference to FIG. 6 it will be observed that the fabric 84 extends downwardly around member 24 passing under that member and then back upwardly to the vicinity of the plane comprised of the spring wires 44. A similar pocket 88 is provided at this edge of the fabric material and a reinforcing bar 90 is inserted in the pocket 88. Staple fasteners 92 are used to attach this reinforcing bar to the spring wires 44 thereby permanently affixing the fabric to the base.

In order to assure that the fabric remains tightly in placae it is desirable in most cases that the fabric 84 be fastened to the base at each end. Thus the fabric 84 extends around member 26 and member 30 at each end and then passes upwardly to the vicinity of the plane comprised of the spring wires. A similar reinforcing bar 90 is inserted into pockets 88 at each end and additional staple fasteners 92 are used to clip the fabric 84 to the spring wires 44.

If desired the depending panel 86 may comprise a flap 87 to extend along the side of the base to provide a finished appearance to the front corners. The panel is provided with apertures 89 to accommodate bolts 76.

From reference to FIG. 6 it will be appreciated that the urethane foam may extend across the seating portion and down the front of the base, if desired.

The method of covering the back element 12 and the end element 14 is essentially similar. The method will be explaned with reference to the end element 14.

The end element 14 is first covered by passing an envelope 100 of FABRINE or TYPAR downwardly over the bent tubular member 66, 68 and 70. This fabric is strong enough to provide the support for any cushions supported by the end elements 14. Next an envelope 102 comprised of synthetic foam cushioning material is passed downwardly over the first envelope 100. Lastly, an envelope 104 of fabric having an upholstered appearance is passed downwardly over the first and second envelopes.

Figure 5:
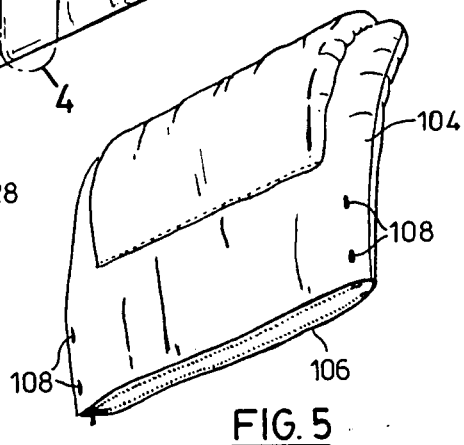
FIG. 5 illustrates the end element of FIG. 1.

Envelope 104 illustrated in FIG. 5 comprises a zipper 106 along its lower edge for retaining the envelope in place. The envelope also comprises four button holes 108 which are located so as to exactly overlie the apertures 74 in the runs 68 and 70. The envelopes of FABRINE or TYPAR and of synthetic foam also comprise suitable openings overlying apertures 74. These openings and the button holes provide unimpeded access of bolts 76 to nuts 62. The zipper 106 when closed will constitute the lower surface of the envelope covering the element 12 and hence is not readily visible even from the side of the seating furniture. Closure means other than zippers may also be used, if desired.

The back element 12 is essentially similar to the end element 14. The "button" holes in the envelopes covering the back element must overlie the apertures 60 in order to permit unimpeded access of bolts 64 to nuts 62. It will be noted that there is no requirement for either the back element 12 or the end element 14 to be planar. The only requirement is that the apertures 60 and 46 must be adjacent and also apertures 74 and 48 must be adjacent. Above the apertures 46 the end element 14 may curve or extend angularly away from the base if this should be desired by the designer. Similarly, above the apertures 48 the end element 14 may curve or extend angularly away from the base as may be desired by the designer. Similarly, the fabric material of the end element 14 may also comprise any form of additional cushions, covers or the like sewn thereto to comprise arm cushions, all as may be desired by the designer. One such example of an integral cushion forming part of the envelope 104 is illustrated in FIG. 5. Additional or other forms of arm cushions placed on the end panel 14 may also be used.

In the embodiment shown in the drawings the fabric of the base portion does not extend over the rear surface of the prism nor over either end surface. It is envisaged that an end element would be used on either end and thus there is no need for fabric at the sides. However, if it is desired to produce furniture having only one end element then the fabric covering the base portion is provided with a depending panel which extends downwardly to cover in the side in a manner identical with that described in association with the front portion of the base. Such a panel would also have a pocket containing a reinforcement rod and staple fastners affixing the panel to the base in the vicinity of the plane comprised by the spring wires 44.

Figure 1:
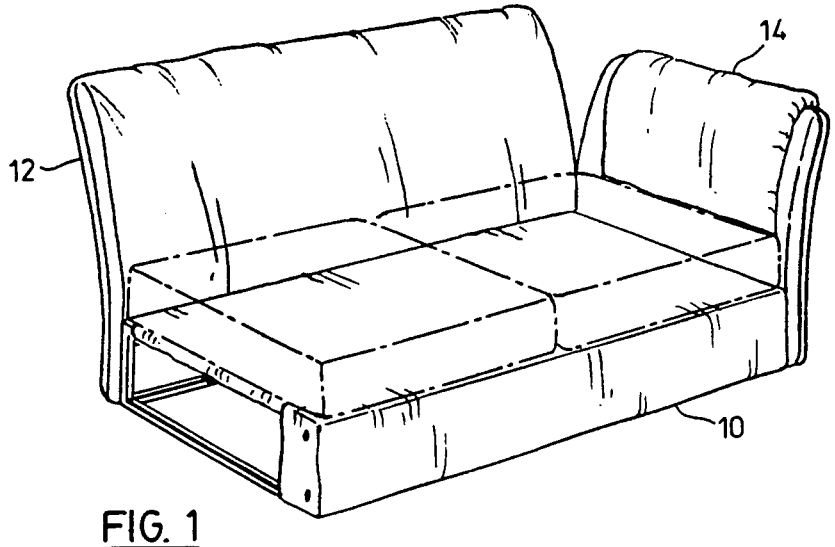
FIG. 1 is a perspective view of a single arm; multiple seat sofa with seat and back cushion removed.

In the embodiment illustrated in FIG. 1 the base 10 rests upon the floor and the end portion 14 extends to the floor. It should be understood however that it is not necessary that the base 10 sit on the floor nor that the end or back elements necessarily terminate flush with the lower surface of the base. The lower surfaces of elements 16, 18, 20 and 22 of the base may be provided with any suitable means of socket for receiving legs, feet, pads or the like as the designer may wish. Alternatively, the height of the base may be such that the base does not reach to the floor and the support from the floor is comprised of two end elements 14 which may extend below the base to the desired amount. Within the structure illustrated and claimed herein substantial freedom is offered to the designer to give the seating furniture any desired appearance and proportion.

When it is desired to support the base on two end elements, it is suggested that the construction of the end elements would have to be slightly modified to provide the required additional strength. This may be accomplished by using heavier gauge materials or by using additional bracing and tubular elements. If desired for appearances sake, the end elements may be manufactured from wood or the like rather than using the upholstered tubular configuration described above. Complete freedom of end element or arm configuration is provided to the designer who is constrained only to have the mounting holes aligned with those of the base.

Although not absolutely necessary, it is suggested that with preferred embodiments loose or fitted cushions be used both on the upper surface of the base 10 as seat cushions and on the forward surface as pictured in FIG. 1 of the back element 12 for supporting back cushions. The shape and number of such cushions is a matter of choice for the furniture designer.

It will be appreciated that a unique furniture structure has been provided. The structure results in seating furniture which has the appearance of being upholstered while not requiring the skills of the traditional upholsterer. The finished product is easily assembled and disassembled for shipment and/or repair and recovering. In addition, the furniture is particularly light being manufactured from tubular metallic materials while still possessing all of the requisite strength for long life and high quality. Within the structure disclosed herein the designer has almost unlimited freedom for the appearance of the finished product, and accordingly, the structure is available for use with a wide range of seating furniture.

Finally, it should be realized that with the design provided, assembly and disassembly may be readily accomplished by unskilled labour. All that is required is the insertion of bolts into the apertures described which may then be tightened in place. It should also be appreciated that the furniture itself can be manufactured using jig welded arrangements to fabricate the base portion. The fabrics when properly cut need only be sewn to comprise the pockets as described and unskilled labour can quickly assemble the fabric to the base using a hog ring gun or similar staple fasteners.

I claim:

1. Knock down seating furniture having:

a base for supporting at least one seat cushion, a back element for supporting at least one back cushion, at least one end element, threaded fastening means for removably securing said back element and said end element to said base, said base comprising, a plurality of tubular metallic members affixed to one another and defining the perimeter of a substantially rectangular prism said prism having members forming an upper seating plane and members forming a lower plane, a plurality of spring wires extending between two of said tubular members in said upper seating plane to comprise a seat cushion supporting plane, a sheet of resilient synthetic foamed cushioning material affixed to at least one of said tubular members and overlying said upper seating plane, and upholstery fabric overlying at least said upper seating plane and said cushioning material, said upholstery fabric having at least one front panel depending from said upper seating plane, said front panel extending from said upper seating plane down to and around at least one of said tubular members in said lower plane and upwardly such that the panel terminates at an edge thereof which is near the said spring wires, and a plurality of staple fasteners fastening the said panel and its said edge to said spring wires, wherein said panel has at least one pocket along said panel edge and said staple fasteners engage said pocket, and wherein said fabric comprises a plurality of side and back depending panels each panel having a panel edge, each panel extending around at least one of said tubular metallic members, each panel having a pocket extending along said panel edge, reinforcing means within said pockets and staple fastening means encompassing said reinforcing means and a portion of said spring wires thereby fastening said fabric to said base.

2. The furniture of claim 1, wherein said reinforcing means comprises a metallic rod.

3. The furniture of claim 1, wherein said fabric comprises at least four depending panels, each said panel extending over at least one tubular metallic member defining said upper seating plane.

* * * * *